US005950762A

United States Patent [19]

George

[11] Patent Number: 5,950,762

[45] Date of Patent: Sep. 14, 1999

[54] LADDER HOSE RETAINER

[76] Inventor: Gregory George, 880 N. Highland Ave., Apt. B-4, Atlanta, Ga. 30306

[21] Appl. No.: 09/041,384

[22] Filed: Mar. 12, 1998

Related U.S. Application Data

[60] Provisional application No. 60/040,964, Mar. 12, 1997.

[51] Int. Cl.[6] ..... A62C 23/04

[52] U.S. Cl. ..... 182/129; 248/77; 248/210

[58] Field of Search ..... 182/129; 248/77, 248/75, 76, 78, 210, 238

[56] References Cited

U.S. PATENT DOCUMENTS

| | | | |
|---|---|---|---|
| 1,123,900 | 1/1915 | Leslie | 248/88 |
| 1,267,305 | 5/1918 | Dalcom | 248/87 |
| 1,743,537 | 1/1930 | Freese | 248/87 |
| 2,455,037 | 11/1948 | Bremer | 248/87 |
| 2,480,906 | 9/1949 | Cox | 248/88 |
| 3,056,571 | 10/1962 | Schofield . | |
| 3,488,068 | 1/1970 | De Voe | 248/88 |
| 3,985,203 | 10/1976 | Erlenbach | 248/210 |

FOREIGN PATENT DOCUMENTS

| | | | |
|---|---|---|---|
| 683720 | 12/1952 | United Kingdom | 182/129 |

*Primary Examiner*—Alvin Chin-Shue
*Attorney, Agent, or Firm*—Thomas, Kayden, Horstemeyer & Risley, L.L.P.

[57] ABSTRACT

A ladder hose retainer 10 for use with a ladder 48 having a ladder rung 50, includes an elongated tubular member 12 adapted to fit within a rung 50, and having a first and a second externally threaded end, 14 and 16. An internally threaded fitting 24 threadedly engages first end 14 and incorporates at least one gripping member 30 such that each gripping member 30 is adapted and arranged to securely engage a hose 58. An internally threaded cap member 22, adapted to threadedly engage second end 16, provides for adjustable mounting of the elongated member 12 within rungs 50 of various sizes. The ladder hose retainer 10 allows the secure retention of a vibrating hose 58 of a spray device to a ladder, thus reducing the vibration and discomfort imparted to an operator by the vibrating spray hose.

1 Claim, 2 Drawing Sheets

LADDER HOSE RETAINER

RELATED APPLICATIONS

This application claims priority to and the benefit of a U.S. Provisional Application, Ser. No. 60/040,964, filed on Mar. 12, 1997.

FIELD OF THE INVENTION

The present invention generally relates to a retainer assembly, and more particularly, to a retainer assembly that partially mounts within the hollow rung of a ladder to retain a device, such as a hose.

BACKGROUND OF THE INVENTION

There are many devices, such as a paint spray systems, pressure washers, or conventional garden hoses, that incorporate a hose segment and spray nozzle for supplying material to be sprayed. Oftentimes, the operator of a spray device can conveniently stand on the ground or another relatively flat, stable surface while maneuvering the hose and spray nozzle to accomplish a specific task. However, there are other times when the operator of a spray device must climb and balance on a ladder while using the spray device.

For example, when the operator of a paint spray device desires to spray paint a house, particularly the portions of the house which are above the operator's shoulders, the operator of the paint spray system must typically use one of his hands to climb and balance on a ladder that is placed adjacent the house, while using the other hand to grasp and manipulate the hose and nozzle of the spray device to achieve the desired paint coverage. Additionally, movement of the sprayed product, e.g. paint, through the incorporated hose, as well as the pressure developed in the hose by the spray device can cause the hose, in some extreme cases to violently vibrate, and in other less extreme cases to vibrate enough to cause discomfort in the operator due to muscle and joint fatigue, and apprehension in the operator due to the tendency of the hose to cause the operator to lose his balance and potentially fall from the ladder.

SUMMARY OF THE INVENTION

Briefly stated, the present invention teaches an apparatus for retaining the hose of a typical spray device, so as to reduce the vibration that is typically transmitted to the operator of the spray device from the hose. The apparatus incorporates an elongated member which affixes to a ladder and an attachment mechanism that is firmly attached to the elongated member. The elongated member, which can be formed of material such as a length of metal tubing, among others, is mounted within and firmly affixed to a rung of a typical extension ladder. The elongated member has opposing ends with one end adapted to receive an adjustable end cap for securely mounting the elongated member within a ladder rung, and the opposing end adapted to receive a fitting which incorporates a clip mechanism with which to securely, but releasably, retain a hose or other device.

Embodiments of the present invention include attachment mechanisms with fixed retaining segments or clips which are formed to grasp a segment of hose, etc, while other embodiments incorporate retaining clips which can be manually adjusted by the operator to firmly grasp a device. Additionally, some embodiments also can include clip members sized and configured for simultaneously retaining hoses of different sizes and shapes from multiple devices.

Objects, features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present inventions, and together with the description serve to explain the principles of the inventions. The components in the drawings are not necessarily to scale, emphasis instead being placed upon clearly illustrating principles of the present inventions.

DETAILED DESCRIPTION OF THE PREFERRED EMBODIMENTS

Figure 1:
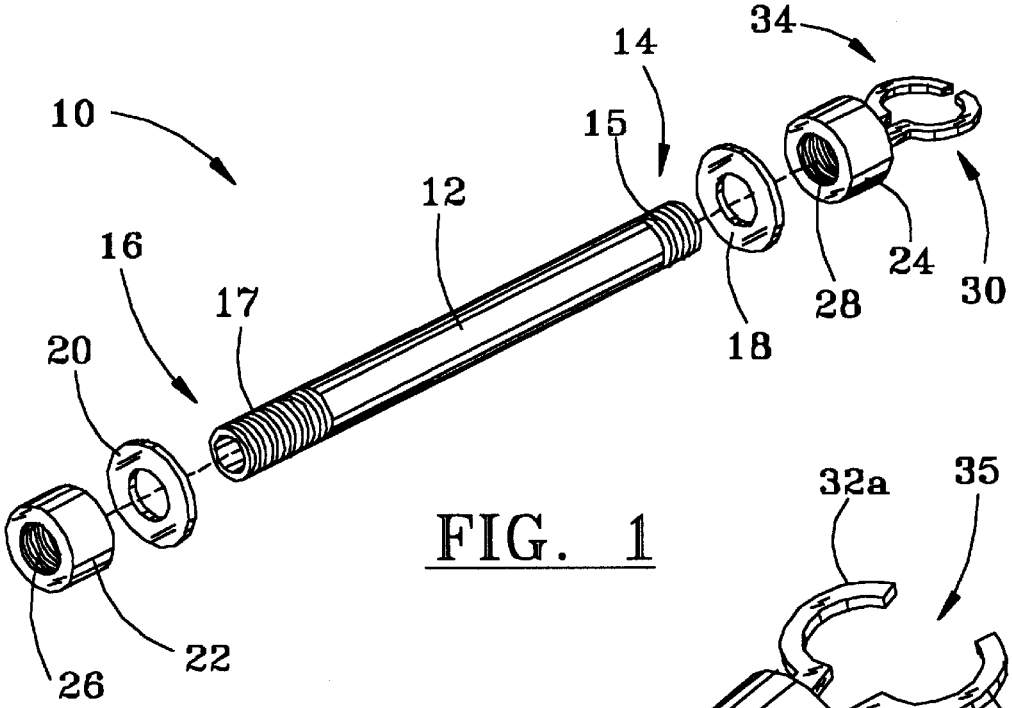
FIG. 1 is an exploded perspective view of the ladder hose retainer of the present invention.

Referring now to the figures, wherein like reference numerals designate like parts throughout the several views, FIG. 1 depicts an exploded view of the preferred embodiment of the ladder hose retainer 10 of the present invention. Ladder hose retainer 10 incorporates an elongated member 12 formed of a length of metal, durable plastic or other material possessing sufficient strength to resist breaking, and of a sufficient length to span the width of a conventional ladder.

As shown in FIG. 1, the elongated member 12 of the preferred embodiment is formed from a segment of tubing having opposing ends 14 and 16, with each end incorporating external threads 15 and 17, respectively. A pair of retainer washers 18 and 20, are adapted to slide over the ends 14 and 16 of elongated member 12 with the washers 18 and 20 retained about the member 12 by an end cap 22 which engages end 16, and a fitting 24 which engages end 14. End cap 22 has internal threads 26 adapted to receive external threads 17 of end 16, and likewise, fitting 24 has internal threads 28 adapted to receive external threads 15 of end 14. Fitting 24 is also configured with a hose attachment or gripping member 30 for retaining or grasping a device, such as a length of hose.

Figure 2A:
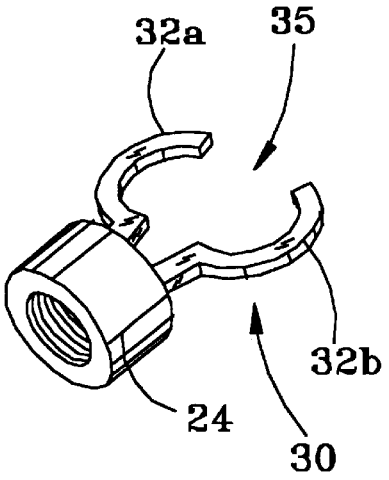
FIG. 2*a* is a perspective view of an alternate embodiment of a hose retainer fitting of the present invention incorporating a manual adjustment mechanism.
Figure 2B:
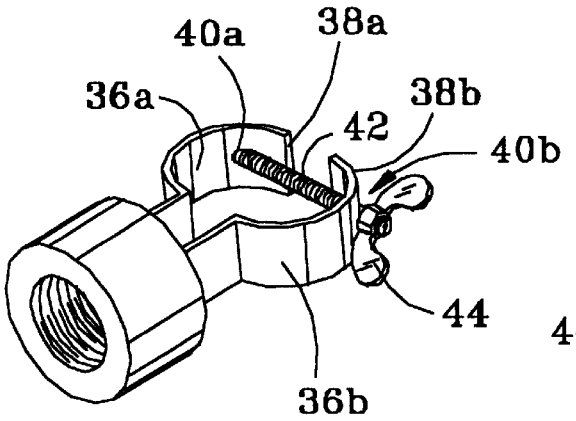
FIG. 2*b* is a perspective view of an alternate embodiment of a hose retainer fitting of the present invention incorporating a bolt and nut as an adjustment mechanism.
Figure 2C:
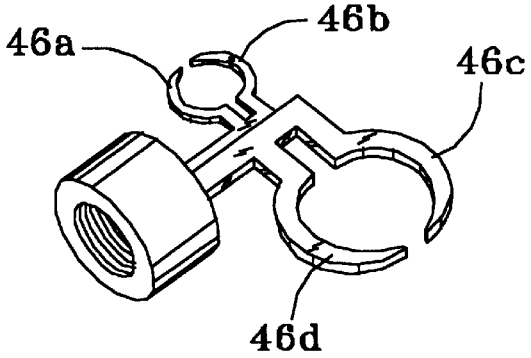
FIG. 2*c* is a perspective view of an alternate embodiment of a hose retainer fitting of the present invention incorporating multiple retention apertures.

As shown in FIGS. 2*a*, 2*b* and 2*c*, fitting 24 can incorporate numerous configurations of hose attachments 30. Referring now to FIG. 2*a*, attachment 30 is shown configured with a pair of hose retainer clips 32*a* and 32*b* which are adapted to securely, but releasably, retain the hose of a spray device (not shown), such as a pressure washer. The clips 32*a* and 32*b* are spring biased to a closed position 34 (FIG. 1),so that the clips 32*a* and 32*b* can grasp a device which is placed between the clips and the clips are released to the closed position 34, the grasped device can then be conveniently removed from the clips 32*a* and 32*b* when the clips are manually displaced against the biasing spring (not shown) to an open position 35.

As shown in FIG. 2*b*, an alternative embodiment of attachment 30 can incorporate a pair of retainer clips 36*a* and 36*b*, with each clip having a receiving end 38*a* and 38*b*, respectively. Adjacent receiving ends 38*a* and 38*b*, each clip incorporates a bore, 40*a* and 40*b*, respectively, for engaging an externally threaded bolt 42, or other mechanical adjusting means, which passes through each bore 40*a* and 40*b*. Bolt 42 is retained by the clips 36*a* and 36*b* by engaging internally threaded nut 44 which also can be selectively screwed or unscrewed down the external threads of bolt 42, thereby urging the clips 36*a* and 36*b* either closer together, such as for grasping a device, or further apart, such as for releasing a device from the attachment 30.

As shown in FIG. 2*c*, alternative embodiments of attachment 30 also can be configured with hose retainer clips of different sizes and shapes (e.g. clips 46*a*, 46*b*, 46*c* and 46*d*), so as to retain hoses and other devices of varying sizes and shapes.

Figure 3:
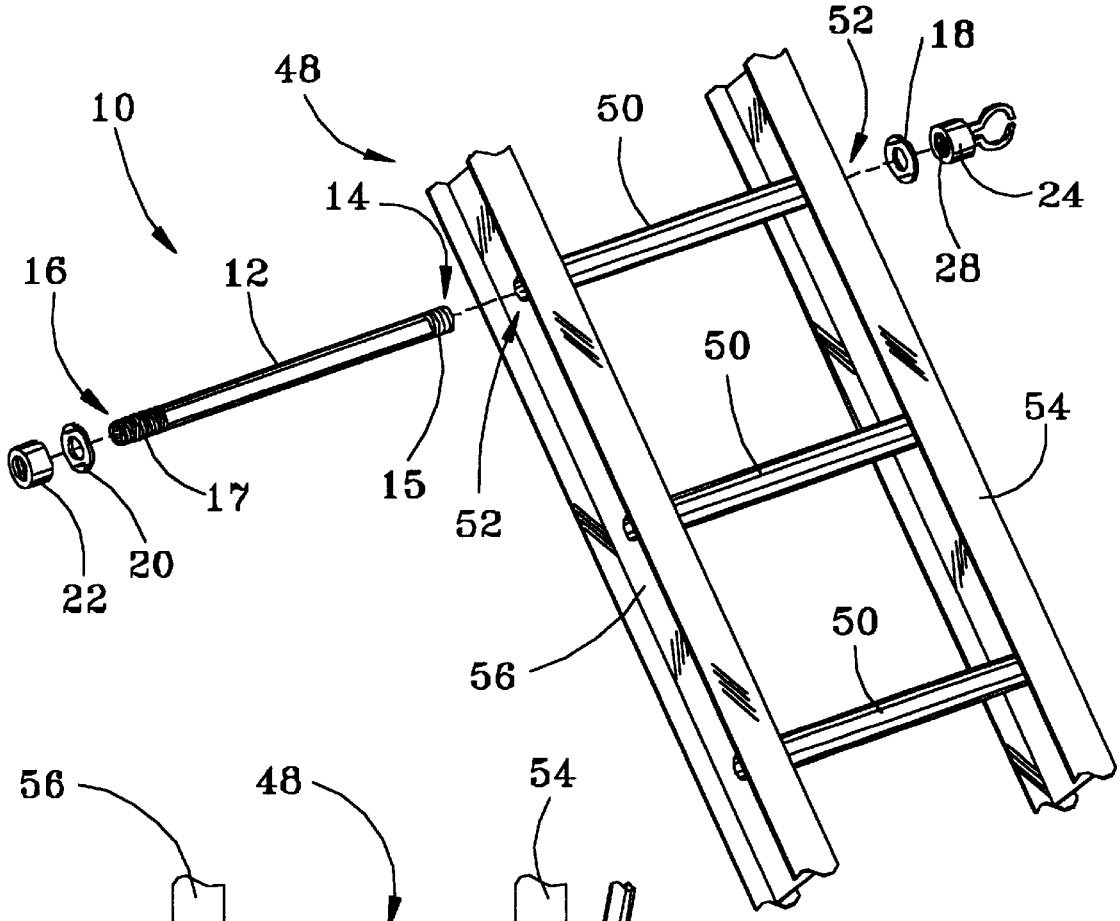
FIG. 3 is an exploded perspective view of the present invention showing assembly detail of the device mounted to the rung of a conventional ladder.

Referring now to FIG. 3, installation of the ladder hose retainer 10 of the present invention to a typical extension ladder 48 is shown. Elongated member 12 is placed within a hollow rung 50 which has been selected at an appropriate height to facilitate the operator working on the ladder 48. Typical placement of the retainer 10 will be through a rung 50 at or below the rung 50 on which the operator anticipates standing. This location typically yields a length of hose which provides a suitable range of motion of the hose and its incorporated nozzle so as not to impede the work of the operator.

Figure 4:
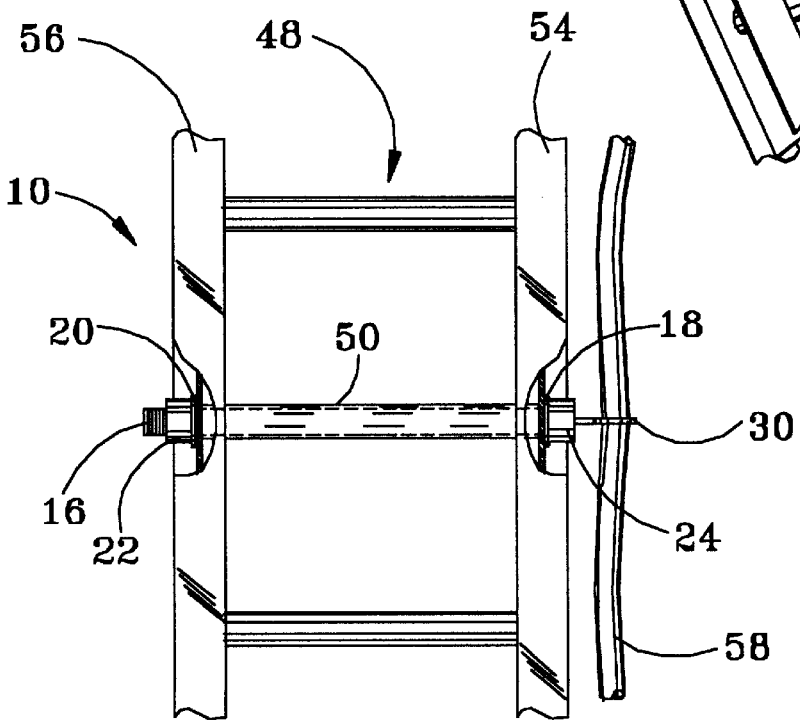
FIG. 4 is a side view of the present invention mounted to a ladder with a hose attached.

Once the member 12 has been placed into the rung 50, the member 12 is slid through the rung 50 until end 14 protrudes from a rung opening 52. Retainer washer 18 is then placed about end 14 and held in place by engaging the internal threads 28 of fitting 24 with the external threads 15 of end 14, and then securely screwing the fitting 24 onto member 12. In this manner, washer 18 is trapped between fitting 24 and the exterior surface of ladder rail 54, thereby preventing the member 12 from pulling back through the rung 50. Similarly, retainer washer 20 is placed about the end 16 of member 12 which protrudes from the opposing end of rung 50, and the internally threaded end cap 22 is then tightened about external threads 17, thereby trapping the washer 20 between the end cap 22 and the exterior surface of ladder rail 56. Thus, the interaction of member 12 with washer 18, ladder rail 54 and fitting 24, as well as washer 20, ladder rail 56 and adjustable end cap 22, act to securely and adjustably retain the ladder hose retainer 10 to ladders of various designs and widths. Once the hose retainer is attached, a hose 58, or other device can be attached to the hose attachment 30 (FIG. 4), thereby reducing the vibration transmitted from a spray device (not shown), through the attached hose 58 and to the operator of the spray device, when the operator is using the spray device while standing on the ladder 48.

The foregoing description has been presented for purposes of illustration and description. It is not intended to be exhaustive or to limit the invention to the precise forms disclosed. Obvious modifications or variations are possible in light of the above teachings. The embodiment or embodiments discussed, however, were chosen and described to provide the best illustration of the principles of the invention and its practical application to thereby enable one of ordinary skill in the art to utilize the invention in various embodiments and with various modifications as are suited to the particular use contemplated.

For example, various hose retainer fittings can be used with the present invention in order to secure many different hose and devices of various sizes. Furthermore, various lengths and widths of elongated members also can be used in order to fit various sizes of ladder rungs.

All such modifications and variations, are within the scope of the invention as determined by the appended claims when interpreted in accordance with the breadth to which they are fairly and legally entitled.

Therefore, the following is claimed:

1. A hose retainer for use with a ladder having a ladder rung, the ladder rung having a bore extending therethrough, said hose retainer consisting of:

an elongated tubular member having a first and a second externally threaded end, said elongated tubular member adapted to fit within the bore of a ladder rung;

a first cap-like internally threaded fitting having an open end which receives said first externally threaded end of said elongated tubular member, said first cap-like internally threaded fitting having a gripping member such that said gripping member is adapted and arranged to securely engage a hose, said gripping member having first and second elongated opposing clip members, each clip member having a first end fixed to an end of the first cap-like internally threaded fitting opposite said open end and extending longitudinally along the longitudinal axis of the elongated tubular member with a clip member on opposite side of said longitudinal axis a bolt and a nut, said first and second clip members each having a bore passing therethrough, said bolt passing through each of said bores, and said nut adjustably engaging said bolt such that said first and second clip members are biased to a closed position by adjusting said nut; and a second fitting having an internally threaded bore extending therethrough, said second fitting adapted to threadedly engage said second externally threaded end of said elongated tubular member such that a rung of a ladder is securely retainable between said first and second fittings by tightening said second fitting against the rung of a ladder, further having first and second washers at respective ends of said elongated tubular member.

* * * * *